US009412305B2

(12) United States Patent
Lee

(10) Patent No.: US 9,412,305 B2
(45) Date of Patent: Aug. 9, 2016

(54) PIXEL CIRCUIT OF AN ORGANIC LIGHT EMITTING DISPLAY DEVICE AND ORGANIC LIGHT EMITTING DISPLAY DEVICE INCLUDING THE SAME

(71) Applicant: SAMSUNG DISPLAY CO., LTD., Yongin, Gyeonggi-Do (KR)

(72) Inventor: Chang-Ho Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 354 days.

(21) Appl. No.: 13/963,644

(22) Filed: Aug. 9, 2013

(65) Prior Publication Data

US 2014/0198136 A1 Jul. 17, 2014

(30) Foreign Application Priority Data

Jan. 16, 2013 (KR) ..... 10-2013-0004759

(51) Int. Cl.
*G09G 3/32* (2016.01)

(52) U.S. Cl.
CPC ..... *G09G 3/3266* (2013.01); *G09G 3/3233* (2013.01); *G09G 2300/0819* (2013.01); *G09G 2300/0842* (2013.01); *G09G 2300/0861* (2013.01); *G09G 2310/0286* (2013.01)

(58) Field of Classification Search
None
See application file for complete search history.

(56) References Cited

U.S. PATENT DOCUMENTS

2005/0212446 A1 9/2005 Eom
2011/0084947 A1* 4/2011 Chung ..... G09G 3/3233 345/211
2012/0050234 A1 3/2012 Jang et al.
2012/0056860 A1* 3/2012 Umezaki ..... G09G 3/3677 345/205

FOREIGN PATENT DOCUMENTS

KR 10-2005-0094668 9/2005
KR 10-2006-0104848 10/2006
KR 10-2012-0019227 3/2012

* cited by examiner

*Primary Examiner* — Kathy Wang-Hurst
*Assistant Examiner* — Douglas M Wilson
(74) *Attorney, Agent, or Firm* — Lewis Roca Rothgerber Christie LLP

(57) ABSTRACT

A pixel circuit according to an embodiment includes: a capacitor; a first switching unit configured to initialize the capacitor in response to a first scan signal received from a first scan line; a second switching unit configured to receive a second scan signal from a second scan line disposed in a first direction from the first scan line, to receive a third scan signal from a third scan line disposed in a second direction opposite to the first direction from the first scan line, and to be turned on in response to one of the second scan signal and the third scan signal that is activated after the first scan signal is activated to store a data signal in the capacitor; and a driving transistor configured to provide a driving current to an OLED in response to the data signal stored in the capacitor.

20 Claims, 13 Drawing Sheets

PIXEL CIRCUIT OF AN ORGANIC LIGHT EMITTING DISPLAY DEVICE AND ORGANIC LIGHT EMITTING DISPLAY DEVICE INCLUDING THE SAME

CROSS REFERENCE TO RELATED APPLICATION

This application claims priority to and the benefit of Korean Patent Application No. 10-2013-0004759 filed on Jan. 16, 2013, the disclosure of which is hereby incorporated by reference in its entirety.

BACKGROUND

1. Field

Example embodiments of the present invention relate to pixel circuits of organic light emitting display devices, and organic light emitting display devices including the pixel circuits.

2. Description of the Related Art

An organic light emitting display device includes a scan driving unit that provides a scan signal, a data driving unit that provides a data signal, and a plurality of pixel circuits that are driven based on the scan signal and the data signal.

The scan driving unit may sequentially provide the scan signal by selecting the plurality of pixel circuits on a line basis using a shift register. The data driving unit may provide the data signal to the plurality of pixel circuits that are selected on a line basis. Each pixel circuit may provide a predetermined driving current corresponding to the data signal to an organic light emitting diode to display an image corresponding to the data signal.

In general, the scan driving unit may perform a unidirectional scan that sequentially applies the scan signal from the topmost scan line to the bottommost scan line on a line basis, however, a bidirectional scan technique that selectively performs a first unidirectional scan from top to bottom or a second unidirectional scan from bottom to top may also be used.

To perform the bidirectional scan, the scan driving unit may include a shift register for sequentially providing the scan signal from the bottommost scan line to the topmost scan line as well as a shift register for sequentially providing the scan signal from the topmost scan line to the bottommost scan line. Accordingly, because at least two shift registers are used to perform the bidirectional scan, the size of the scan driving unit may be increased, and a bezel of the organic light emitting display device may be increased.

SUMMARY

Aspects of the present invention provide a pixel circuit of an organic light emitting display device capable of being driven by a first unidirectional scan from top to bottom, a second unidirectional scan from bottom to top, and/or a bidirectional scan.

Aspects of the present invention provide an organic light emitting display device that drives pixel circuits by performing a first unidirectional scan from top to bottom, a second unidirectional scan from bottom to top, and/or a bidirectional scan.

According to one aspect of the present invention, there is provided a pixel circuit of an organic light emitting device including: a storage capacitor; a first switching unit configured to initialize the storage capacitor in response to a first scan signal received from a first scan line; a second switching unit configured to receive a second scan signal from a second scan line disposed in a first direction from the first scan line, to receive a third scan signal from a third scan line disposed in a second direction opposite to the first direction from the first scan line, and configured to be turned on in response to one of the second scan signal and the third scan signal that is activated after the first scan signal is activated to store a data signal in the storage capacitor; a driving transistor configured to provide a driving current according to the data signal stored in the storage capacitor; and an organic light emitting diode configured to emit light in response to the driving current.

When the first scan signal, the second scan signal, and the third scan signal are sequentially activated in order of the second scan signal applied through the second scan line, the first scan signal applied through the first scan line disposed in the second direction from the second scan line, and the third scan signal applied through the third scan line disposed in the second direction from the first scan line, the second switching unit may be configured to turn on in response to the third scan signal to store the data signal in the storage capacitor.

When the first scan signal, the second scan signal, and the third scan signal are sequentially activated in order of the third scan signal applied through the third scan line, the first scan signal applied through the first scan line disposed in the first direction from the third scan line, and the second scan signal applied through the second scan line disposed in the first direction from the first scan line, the second switching unit may be configured to turn on in response to the second scan signal to store the data signal in the storage capacitor.

The first switching unit may include: a first transistor configured to apply an initialization voltage to the storage capacitor in response to the first scan signal.

The first switching unit may include: a plurality of first transistors connected in series, the plurality of first transistors configured to apply an initialization voltage to the storage capacitor in response to the first scan signal.

The second switching unit may include: a second transistor configured to couple a data line through which the data signal is received to a first terminal of the driving transistor in response to the second scan signal; and a third transistor configured to couple the data line to the first terminal of the driving transistor in response to the third scan signal.

The second switching unit may include: a plurality of second transistors connected in series, the plurality of second transistors configured to couple a data line through which the data signal is received to a first terminal of the driving transistor in response to the second scan signal; and a plurality of third transistors connected in series, the plurality of third transistors configured to couple the data line to the first terminal of the driving transistor in response to the third scan signal. Here, each of the plurality of second transistors may be connected in parallel with a corresponding one of the plurality of third transistors.

The pixel circuit may further include: a third switching unit configured to couple a second terminal of the driving transistor to the storage capacitor. Here, when the second switching unit is turned on, the second switching unit may be configured to transfer the data signal to a first terminal of the driving transistor, the driving transistor may be configured to transfer the data signal from the first terminal thereof to the second terminal thereof, and the third switching unit may be configured to transfer the data signal from the second terminal of the driving transistor to the storage capacitor.

The third switching unit may include: a fourth transistor configured to couple the second terminal of the driving transistor to the storage capacitor in response to the second scan signal; and a fifth transistor configured to couple the second terminal of the driving transistor to the storage capacitor in response to the third scan signal.

The third switching unit may include: a plurality of fourth transistors connected in series, the plurality of fourth transistors configured to couple the second terminal of the driving transistor to the storage capacitor in response to the second scan signal; and a plurality of fifth transistors connected in series, the plurality of fifth transistors configured to couple the second terminal of the driving transistor to the storage capacitor in response to the third scan signal. Here, each of the plurality of fourth transistors may be connected in parallel with a corresponding one of the plurality of fifth transistors.

The third switching unit may include: a diode-connected transistor coupled between the second terminal of the driving transistor and the storage capacitor.

The pixel circuit may further include: a first emission control transistor configured to couple a power supply to the driving transistor in response to an emission control signal; and a second emission control transistor configured to couple the driving transistor to the organic light emitting diode in response to the emission control signal.

At least one of the driving transistor, the first switching unit, and the second switching unit may include a PMOS transistor.

At least one of the driving transistor, the first switching unit, and the second switching unit may include an NMOS transistor.

According to another aspect of the present invention, there is provided a pixel circuit of an organic light emitting device including: a storage capacitor including a first electrode coupled to a first node and a second electrode coupled to a power supply; a first transistor having a first terminal coupled to the first node, a second terminal coupled to an initialization voltage power supply, and a gate terminal coupled to a first scan line; a second transistor having a first terminal coupled to a data line, a second terminal coupled to a second node, and a gate terminal coupled to a second scan line; a third transistor having a first terminal coupled to the data line, a second terminal coupled to the second node, and a gate terminal coupled to a third scan line; a driving transistor having a first terminal coupled to the second node, a second terminal coupled to a third node, and a gate terminal coupled to the first node; a fourth transistor having a first terminal coupled to the third node, a second terminal coupled to the first node, and a gate terminal coupled to the second scan line; a fifth transistor having a first terminal coupled to the third node, a second terminal coupled to the first node, and a gate terminal coupled to the third scan line; and an organic light emitting diode configured to emit light in response to a driving current received from the driving transistor.

The second scan line may be disposed in a first direction from the first scan line, and the third scan line may be disposed in a second direction opposite to the first direction from the first scan line, a first scan signal, a second scan signal, and a third scan signal may be received from the first scan line, the third scan line, and the third scan line, respectively, and when the first scan signal, the second scan signal, and the third scan signal are sequentially activated in order of the second scan signal applied through the second scan line, the first scan signal applied through the first scan line disposed in the second direction from the second scan line, and the third scan signal applied through the third scan line disposed in the second direction from the first scan line, the data line may be configured to be coupled to the storage capacitor through the third transistor, the driving transistor, and the fifth transistor.

The second scan line may be disposed in a first direction from the first scan line, and the third scan line may be disposed in a second direction opposite to the first direction from the first scan line, a first scan signal, a second scan signal, and a third scan signal may be applied through the first scan line, the second scan line, and the third scan line, respectively, and when the first scan signal, the second scan signal, and the third scan signal are sequentially activated in order of the third scan signal applied through the third scan line, the first scan signal applied through the first scan line disposed in the first direction from the third scan line, and the second scan signal applied through the second scan line disposed in the first direction from the first scan line, the data line may be configured to be coupled to the storage capacitor through the second transistor, the driving transistor, and the fourth transistor.

The pixel circuit may further include: a first emission control transistor having a first terminal coupled to the power supply, a second terminal coupled to the second node, and a gate terminal coupled to an emission control line; and a second emission control transistor having a first terminal coupled to the third node, a second terminal coupled to an anode electrode of the organic light emitting diode, and a gate terminal coupled to the emission control line.

At least one of the first transistor, the second transistor, the third transistor, the fourth transistor, the fifth transistor, and the driving transistor may include a PMOS transistor.

At least one of the first transistor, the second transistor, the third transistor, the fourth transistor, the fifth transistor, and the driving transistor may include an NMOS transistor.

According to another aspect of the present invention, an organic light emitting device includes a plurality of pixel circuits, each of the plurality of pixel circuits including: a storage capacitor; a first switching unit configured to initialize the storage capacitor in response to a first scan signal received from a first scan line; a second switching unit configured to receive a second scan signal from a second scan line disposed in a first direction from the first scan line, to receive a third scan signal from a third scan line disposed in a second direction opposite to the first direction from the first scan line, and to be turned on in response to one of the second scan signal and the third scan signal that is activated after the first scan signal is activated to store a data signal in the storage capacitor; a driving transistor configured to provide a driving current according to the data signal stored in the storage capacitor; and an organic light emitting diode configured to emit light according to the driving current.

BRIEF DESCRIPTION OF THE DRAWINGS

The above and other aspects and features of the present invention may be understood in detail from the following description taken in conjunction with the accompanying drawings, in which.

DETAILED DESCRIPTION

Figure 1:
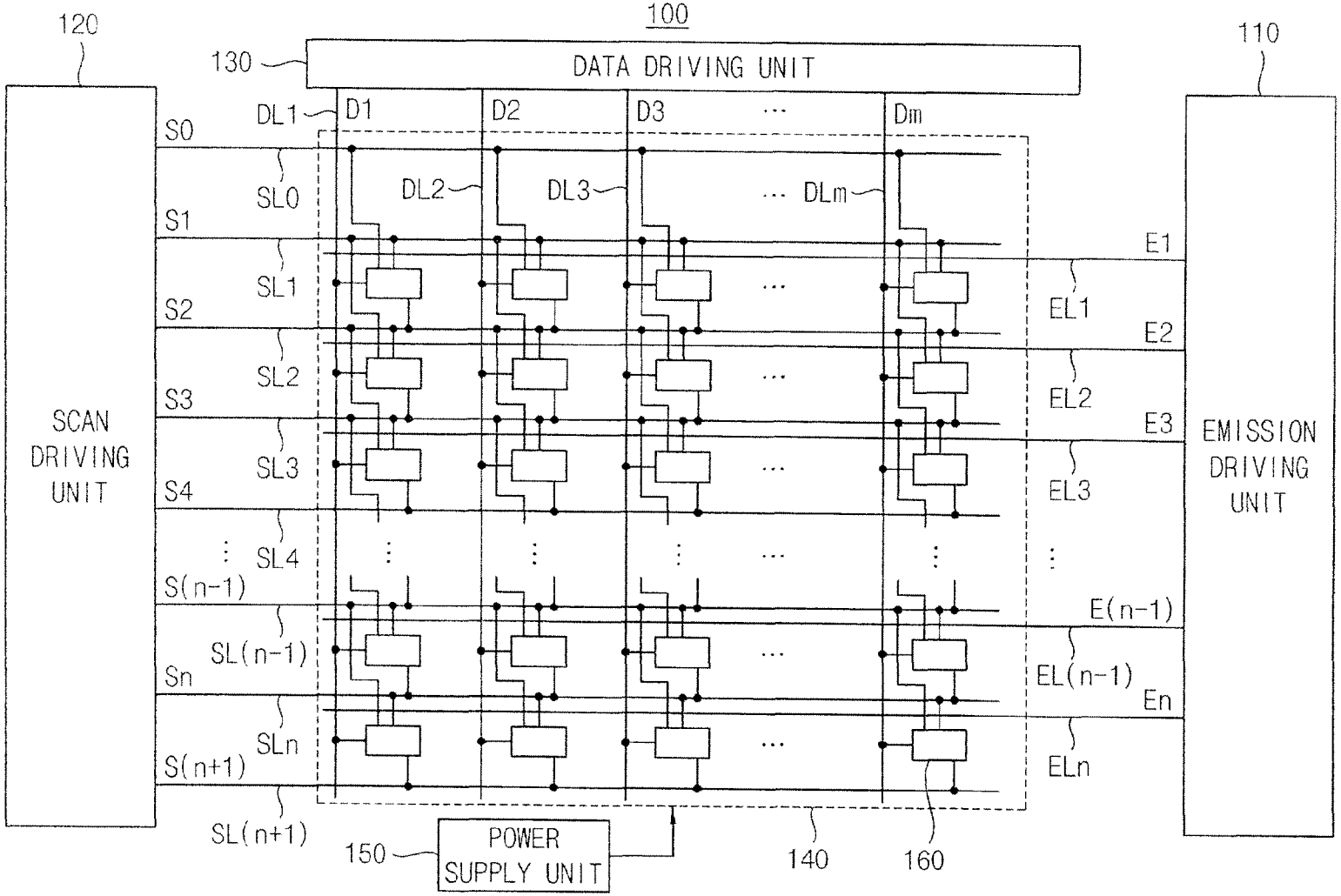
FIG. 1 is a block diagram illustrating an organic light emitting display device in accordance with example embodiments.

Example embodiments of the present invention are described more fully hereinafter with reference to the accompanying drawings. The present invention may, however, be embodied in many different forms and should not be construed as limited to the example embodiments set forth herein. In the drawings, the sizes and relative sizes of layers and regions may be exaggerated for clarity.

It will be understood that when an element or layer is referred to as being "on," "connected to" or "coupled to" another element or layer, it may be directly on, connected or coupled to the other element or layer or one or more intervening elements or layers may be present. In contrast, when an element is referred to as being "directly on," "directly connected to" or "directly coupled to" another element or layer, there are no intervening elements or layers present. Like or similar reference numerals refer to like or similar elements throughout. As used herein, the term "and/or" includes any and all combinations of one or more of the associated listed items.

It will be understood that, although the terms "first," "second," "third," etc. may be used herein to describe various elements, components, regions, layers, patterns and/or sections, these elements, components, regions, layers, patterns and/or sections should not be limited by these terms. These terms are only used to distinguish one element, component, region, layer pattern or section from another region, layer, pattern or section. Thus, a first element, component, region, layer or section discussed below could be termed a second element, component, region, layer or section without departing from the scope of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this present invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram illustrating an organic light emitting display device in accordance with example embodiments.

Referring to FIG. 1, an organic light emitting display device 100 includes an emission driving unit 110, a scan driving unit 120, a data driving unit 130 and a pixel array unit 140. In some example embodiments, the organic light emitting display device 100 may further include a power supply unit 150.

The emission driving unit 110 may be coupled to the pixel array unit 140 through a plurality of emission control lines EL1, EL2, EL3, EL(n−1) and ELn, and may control pixel circuits 160 included in the pixel array unit 140 to emit light by applying a plurality of emission control signals E1, E2, E3, E(n−1) and En to the pixel circuits 160 through the plurality of emission control lines EL1, EL2, EL3, EL(n−1) and ELn.

The scan driving unit 120 may be coupled to the pixel array unit 140 through a plurality of scan lines SL0, SL1, SL2, SL3, SL4, SL(n−1), SLn and SL(n+1), and may control the pixel circuits 160 to store data signals D1, D2, D3 and Dm by applying a plurality of scan signals S0, S1, S2, S3, S4, S(n−1), Sn and S(n+1) to the pixel circuits 160 through the plurality of scan lines SL0, SL1, SL2, SL3, SL4, SL(n−1), SLn and SL(n+1).

The data driving unit 130 may be coupled to the pixel array unit 140 through a plurality of data lines DL1, DL2, DL3 and DLm, and may apply the data signals D1, D2, D3 and Dm corresponding to desired gray levels to the pixel circuits 160 through the plurality of data lines DL1, DL2, DL3 and DLm.

The pixel array unit 140 may include n*m pixel circuits 160 coupled to the n+2 scan lines SL0, SL1, SL2, SL3, SL4, SL(n−1), SLn and SL(n+1) extending in parallel with each other in a row direction, coupled to the n emission control lines EL1, EL2, EL3, EL(n−1) and ELn extending in parallel with each other in the row direction, and coupled to the m data lines DL1, DL2, DL3 and DLm extending in parallel with each other in a column direction, where each of n and m is an integer greater than 1. The pixel circuits 160 may receive the scan signals S0, S1, S2, S3, S4, S(n−1), Sn and S(n+1) through the scan lines SL0, SL1, SL2, SL3, SL4, SL(n−1), SLn and SL(n+1), may receive the emission control signals E1, E2, E3, E(n−1) and En through the emission control lines EL1, EL2, EL3, EL(n−1) and ELn, and may receive the data signals D1, D2, D3 and Dm through the data lines DL1, DL2, DL3 and DLm. The pixel circuits 160 may store the data signals D1, D2, D3 and Dm in response to the scan signals S0, S1, S2, S3, S4, S(n−1), Sn and S(n+1), and may emit light with luminance corresponding to the data signals D1, D2, D3 and Dm in response to the emission control lines EL1, EL2, EL3, EL(n−1) and ELn.

The power supply unit 150 may apply a power supply voltage and an initialization voltage to the pixel circuits 160.

Figure 2:
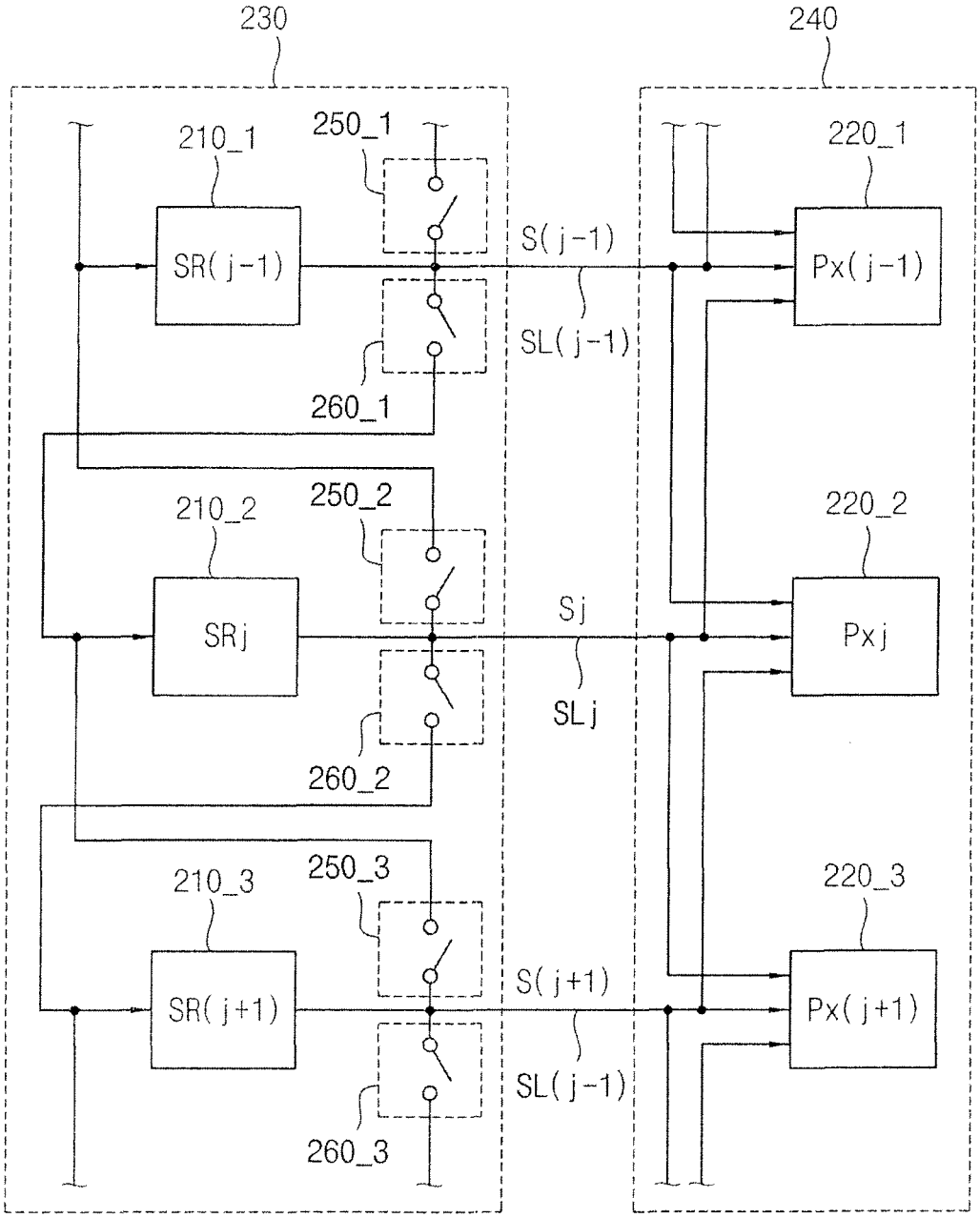
FIG. 2 is a block diagram illustrating a scan driving unit and a pixel array unit included in an organic light emitting display device in accordance with example embodiments.

FIG. 2 is a block diagram illustrating a scan driving unit and a pixel array unit included in an organic light emitting display device in accordance with example embodiments.

Referring to FIG. 2, a scan driving unit 230 may include a shift register having a plurality of stages 210_1, 210_2 and 210_3 that are selectively coupled in series in a first direction (e.g., in a direction from bottom to top) or in a second direction (e.g., in a direction from top to bottom) opposite to the first direction, first switches 250_1, 250_2 and 250_3 for coupling the plurality of stages 210_1, 210_2 and 210_3 in the first direction, and second switches 260_1, 260_2 and 260_3 for coupling the plurality of stages 210_1, 210_2 and 210_3 in the second direction. Each of the first switches 250_1, 250_2 and 250_3 and the second switches 260_1, 260_2 and 260_3 may be implemented with a transistor.

For example, in a case where the first switches 250_1, 250_2 and 250_3 are closed (or turned on), and the second switches 260_1, 260_2 and 260_3 are open (or turned off), the plurality of stages 210_1, 210_2 and 210_3 may be sequentially coupled in the first direction (e.g., in a direction from the bottommost scan line to the topmost scan line of an organic light emitting display device). That is, an output of a (j+1)-th stage 210_3 may be coupled to an input of a j-th stage 210_2 disposed in the first direction from the (j+1)-th stage 210_3, and an output of the j-th stage 210_2 may be coupled to an input of a (j−1)-th stage 210_1 disposed in the first direction from the j-th stage 210_2. In this case, scan signals S(j−1), Sj and S(j+1) may be sequentially activated, for example, in order of a (j+1)-th scan signal S(j+1) applied through a (j+1)-th scan line SL(j+1), a j-th scan signal Sj applied through a j-th scan line SLj disposed in the first direction from the (j+1)-th scan line SL(j+1), and a (j−1)-th scan signal S(j−1) applied through a (j−1)-th scan line SL(j−1) disposed in the first direction from the j-th scan line SLj.

In a case where the first switches 250_1, 250_2 and 250_3 are open (or turned off), and the second switches 260_1, 260_2 and 260_3 are closed (or turned on), the plurality of stages 210_1, 210_2 and 210_3 may be sequentially coupled in the second direction (e.g., in a direction from the topmost scan line to the bottommost scan line of the organic light emitting display device). That is, an output of the (j−1)-th stage 210_1 may be coupled to the input of the j-th stage 210_2 disposed in the second direction from the (j−1)-th stage 210_1, and the output of the j-th stage 210_2 may be coupled to an input of the (j+1)-th stage 210_3 disposed in the second direction from the j-th stage 210_2. In this case, scan signals S(j−1), Sj and S(j+1) may be sequentially activated, for example, in order of the (j−1)-th scan signal S(j−1) applied through the (j−1)-th scan line SL(j−1), the j-th scan signal Sj applied through the j-th scan line SLj disposed in the second direction from the (j−1)-th scan line SL(j−1), and the (j+1)-th scan signal S(j+1) applied through a (j+1)-th scan line SL(j+1) disposed in the second direction from the j-th scan line SLj.

As described above, the scan driving unit 230 may selectively perform a first unidirectional scan from bottom to top by turning on the first switches 250_1, 250_2 and 250_3 or a second unidirectional scan from top to bottom by turning on the second switches 260_1, 260_2 and 260_3. That is, the scan driving unit 230, according to example embodiments of the present invention, performs a bidirectional scan from bottom to top or from top to bottom using a single shift register. In contrast, a conventional scan driving unit uses at least two shift registers to perform a bidirectional scan. Because the scan driving unit 230 of example embodiments of the present invention includes the single shift register, the scan driving unit 230 has a small size, and the organic light emitting display device according to example embodiments has a narrow bezel.

The stages 210_1, 210_2 and 210_3 of the shift register may provide the scan signals S(j−1), Sj and S(j+1) to pixel circuits 220_1, 220_2 and 220_3 included in a pixel array unit 240 through the scan lines S(j−1), Sj and S(j+1).

A pixel circuit 220_2 located at a j-th row may receive the (j−1)-th, j-th and (j+1)-th scan signals S(j−1), Sj and S(j+1) from the (j−1)-th, j-th and (j+1)-th stages 210_1, 210_2 and 210_3. The pixel circuit 220_2 may perform an initialization operation, a data storing operation, etc. in either case where the first unidirectional scan from bottom to top or the second unidirectional scan from top to bottom is performed. For example, in a case where the scan driving unit 230 performs the first unidirectional scan from bottom to top, the pixel circuit 220_2 may receive the scan signals S(j−1), Sj and S(j+1) in order of the (j+1)-th scan signal S(j+1), the j-th scan signal Sj and the (j−1)-th scan signal S(j−1), and may operate by performing the initialization operation in response to the j-th scan Sj and by performing the data storing operation in response to the (j−1)-th scan signal S(j−1). Further, in a case where the scan driving unit 230 performs the second unidirectional scan from top to bottom, the pixel circuit 220_2 may receive the scan signals S(j−1), Sj and S(j+1) in order of the (j−1)-th scan signal S(j−1), the j-th scan signal Sj and the (j+1)-th scan signal S(j+1), and may operate by performing the initialization operation in response to the j-th scan Sj and by performing the data storing operation in response to the (j+1)-th scan signal S(j+1).

As described above, in the organic light emitting display device according to example embodiments, the scan driving unit 230 may perform the bidirectional scan from top to bottom or from bottom to top using the single shift register. Further, the pixel circuits 220_1, 220_2 and 220_3 included in the pixel array unit 240 may operate in any case (e.g., where the first unidirectional scan from bottom to top, the second unidirectional scan from top to bottom, or the bidirectional scan is performed).

Figure 3:
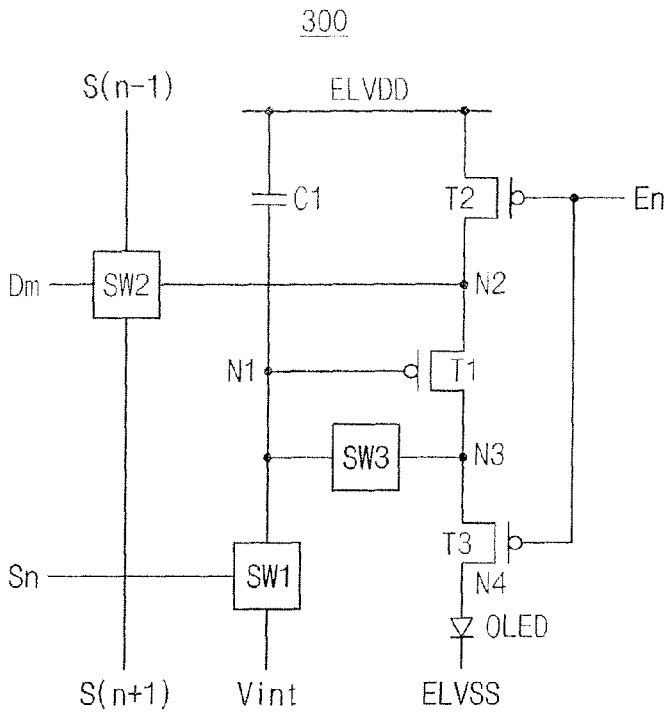
FIG. 3 is a circuit diagram illustrating a pixel circuit of an organic light emitting display device in accordance with example embodiments.

FIG. 3 is a circuit diagram illustrating a pixel circuit of an organic light emitting display device in accordance with example embodiments. For convenience of description, FIG. 3 illustrates a pixel circuit 300 located corresponding to an m-th data line, an n-th scan line and an n-th emission control line.

Referring to FIG. 3, the pixel circuit 300 of the organic light emitting display device may include a storage capacitor C1, a first switching unit SW1, a second switching unit SW2, a third switching unit SW3, a driving transistor T1, a first emission control transistor T2, a second emission control transistor T3 and an organic light emitting diode OLED. The storage capacitor C1 may have a first electrode coupled to a high power supply voltage ELVDD and a second electrode coupled to a first node N1. The first switching unit SW1 may have a first terminal coupled to an initialization voltage Vint and a second terminal coupled to the first node N1, and may be controlled by a first scan signal Sn applied through a first scan line. The second switching unit SW2 may have a first terminal coupled to a data line through which a data signal Dm is applied and a second terminal coupled to a second node N2, and may be controlled by one of a second scan signal S(n−1) applied through a second scan line and a third scan signal S(n+1) applied through a third scan line. The third switching unit SW3 may have a first terminal coupled to the first node N1 and a second terminal coupled to a third node N3. The driving transistor T1 may be implemented with a PMOS transistor having a gate terminal coupled to the first node N1, a source terminal coupled to the second node N2, and a drain terminal coupled to the third node N3. The first emission control transistor T2 may be implemented with a PMOS transistor having a gate terminal coupled to an emission control line through which an emission control signal En is applied, a source terminal coupled to the high power supply voltage ELVDD, and a drain coupled to the second node N2. The second emission control transistor T3 may be implemented with a PMOS transistor having a gate terminal coupled to the emission control line through which the emission control signal En is applied, a source terminal coupled to the third node N3, and a drain terminal coupled to a fourth node N4. The organic light emitting diode OLED may have an anode electrode coupled to the fourth node N4 and a cathode electrode coupled to a low power supply voltage ELVSS.

The first switching unit SW1 may initialize the storage capacitor C1 by applying the initialization voltage Vint to the first node N1 in response to the first scan signal Sn applied through the first scan line.

In a case where a scan driving unit included in the organic light emitting display device performs a first unidirectional scan that sequentially applies the scan signals S(n−1), Sn and S(n+1) to the scan lines in a first direction from the bottommost scan line to the topmost scan line, or in a case where the first through third scan signals S(n−1), Sn and S(n+1) are activated in order of the third scan signal S(n+1) applied through the third scan line, the first scan signal Sn applied through the first scan line disposed in the first direction from the third scan line, and the second scan signal S(n−1) applied through the second scan line disposed in the first direction from the first scan line, the second switching unit SW2 may be turned on in response to the second scan signal S(n−1), which is activated after the first scan signal Sn is activated, to store the data signal Dm in the storage capacitor C1.

Further, in a case where the scan driving unit performs a second unidirectional scan that sequentially applies the scan signals S(n−1), Sn and S(n+1) to the scan lines in a second direction from the topmost scan line to the bottommost scan line, or in a case where the first through third scan signals S(n−1), Sn and S(n+1) are activated in order of the second scan signal S(n−1) applied through the second scan line, the first scan signal Sn applied through the first scan line disposed in the second direction from the second scan line, and the third scan signal S(n+1) applied through the third scan line disposed in the second direction from the first scan line, the second switching unit SW2 may be turned on in response to the third scan signal S(n+1), which is activated after the first scan signal Sn is activated, to store the data signal Dm in the storage capacitor C1.

That is, the second switching unit SW2 may receive the second scan signal S(n−1) applied through the second scan line disposed in the first direction from the first scan line, and may further receive the third scan signal S(n+1) applied through the third scan line dispose in the second direction opposite to the first direction from the first scan line, and may transfer the data signal Dm from the data line to the second node N2 in response to one of the second scan signal S(n−1) and the third scan signal S(n+1) that is activated after the first scan signal Sn is activated.

The driving transistor T1 may be turned on in response to the initialization voltage Vint stored in the storage capacitor C1, and the turned-on driving transistor T1 may transfer the data signal Dm from the second node N2 to the third node N3.

The third switching unit SW3 may store the data signal Dm in the storage capacitor C1 by transferring the data signal Dm from the third node N3 to the first node N1, and may perform threshold voltage compensation by diode-connecting the driving transistor T1.

The first emission control transistor T2 may be turned off to decouple the second node N2 from the high power supply voltage ELVDD until the data signal Dm is stored in the storage capacitor C1.

The second emission control transistor T3 may be turned off to decouple the third node N3 from the fourth node N4 until the data signal Dm is stored in the storage capacitor C1.

After the data signal Dm is stored in the storage capacitor C1, the first and second emission control transistors T2 and T3 may be turned on in response to the emission control signal En applied through the emission control line. While the first and second emission control transistors T2 and T3 are turned on, the organic light emitting diode OLED may emit light based on a driving current generated by the driving transistor T1 in response to the data signal Dm stored in the storage capacitor C1.

As described above, the pixel circuit 300 according to example embodiments may initialize the storage capacitor C1 in response to the first scan signal Sn. When the scan driving unit performs the first unidirectional scan from bottom to top, the pixel circuit 300 may store the data signal Dm in the storage capacitor C1 through the second switching unit SW2, the driving transistor T1 and the third switching unit SW3 in response to the second scan signal S(n−1) that is activated after the first scan signal Sn is activated. Further, when the scan driving unit performs the second unidirectional scan from top to bottom, the pixel circuit 300 may store the data signal Dm in the storage capacitor C1 through the second switching unit SW2, the driving transistor T1 and the third switching unit SW3 in response to the third scan signal S(n+1) that is activated after the first scan signal Sn is activated. Thus, the pixel circuit 300 according to example embodiments may perform the initialization operation, the data storing operation, the light emitting operation, etc. in either case where the first unidirectional scan from bottom to top or the second unidirectional scan from top to bottom is performed. That is, the pixel circuit 300 according to example embodiments may operate in any case (e.g., where the first unidirectional scan from bottom to top, the second unidirectional scan from top to bottom, or the bidirectional scan is performed).

Figure 4:
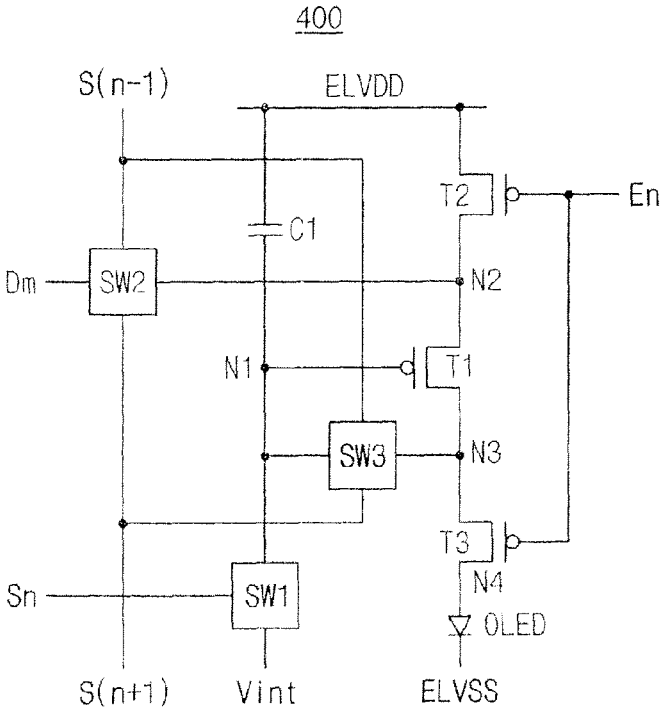
FIG. 4 is a circuit diagram illustrating a pixel circuit of an organic light emitting display device in accordance with example embodiments.

FIG. 4 is a circuit diagram illustrating a pixel circuit of an organic light emitting display device in accordance with example embodiments.

Referring to FIG. 4, a pixel circuit 400 of an organic light emitting display device may include a storage capacitor C1, a first switching unit SW1, a second switching unit SW2, a third switching unit SW3, a driving transistor T1, a first emission control transistor T2, a second emission control transistor T3 and an organic light emitting diode OLED. The storage capacitor C1 may have a first electrode coupled to a high power supply voltage ELVDD and a second electrode coupled to a first node N1. The first switching unit SW1 may have a first terminal coupled to an initialization voltage Vint and a second terminal coupled to the first node N1, and may be controlled by a first scan signal Sn applied through a first scan line. The second switching unit SW2 may have a first terminal coupled to a data line through which a data signal Dm is applied and a second terminal coupled to a second node N2, and may be controlled by one of a second scan signal S(n−1) applied through a second scan line and a third scan signal S(n+1) applied through a third scan line. The third switching unit SW3 may have a first terminal coupled to the first node N1 and a second terminal coupled to a third node N3, and may be controlled by one of the second scan signal S(n−1) and the third scan signal S(n+1). The driving transistor T1 may be implemented with a PMOS transistor having a gate terminal coupled to the first node N1, a source terminal coupled to the second node N2, and a drain terminal coupled to the third node N3. The first emission control transistor T2 may be implemented with a PMOS transistor having a gate terminal coupled to an emission control line through which an emission control signal En is applied, a source terminal coupled to the high power supply voltage ELVDD, and a drain coupled to the second node N2. The second emission control transistor T3 may be implemented with a PMOS transistor having a gate terminal coupled to the emission control line through which the emission control signal En is applied, a source terminal coupled to the third node N3, and a drain terminal coupled to a fourth node N4. The organic light emitting diode OLED may have an anode electrode coupled to the fourth node N4 and a cathode electrode coupled to a low power supply voltage ELVSS.

The pixel circuit 400 of FIG. 4 may have similar configuration to a pixel circuit 300 of FIG. 3, except for the third switching unit SW3.

The third switching unit SW3 may be coupled between the first node N1 and the third node N3, and may be coupled to the second scan line through which the second scan signal S(n−1) is applied and to the third scan line through which the third scan signal S(n+1) is applied. The third switching unit SW3 may store the data signal Dm in the storage capacitor C1 by transferring the data signal Dm from the third node N3 to the first node N1 in response to one of the second scan signal S(n−1) and the third scan signal S(n+1) that is activated after the first scan signal Sn is activated (e.g., according to the scan direction), and may perform threshold voltage compensation by diode-connecting the driving transistor T1 in response to one of the second scan signal S(n−1) and the third scan signal S(n+1) that is activated after the first scan signal Sn is activated (e.g., according to the scan direction).

Figure 5:
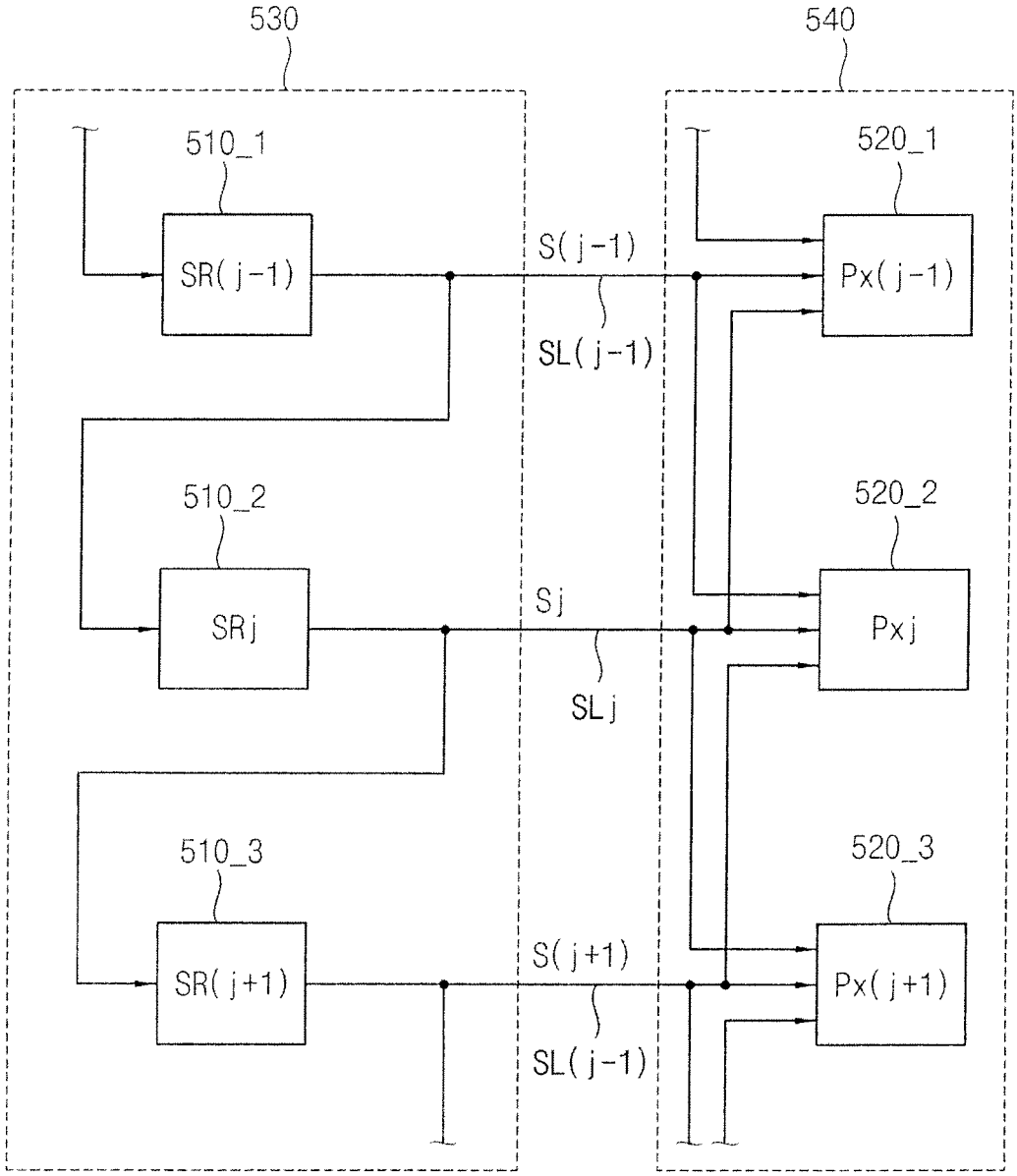
FIG. 5 is a block diagram illustrating a scan driving unit and a pixel array unit included in an organic light emitting display device in accordance with example embodiments.

FIG. 5 is a block diagram illustrating a scan driving unit and a pixel array unit included in an organic light emitting display device in accordance with example embodiments.

Referring to FIG. 5, a scan driving unit 530 may include a plurality of stages 510_1, 510_2 and 510_3 that are sequentially coupled in a direction from top to bottom.

In some example embodiments, the scan driving unit 530 illustrated in FIG. 5 may correspond to a scan driving unit 230 illustrated in FIG. 2 where first switches 250_1, 250_2 and 250_3 are turned off and second switches 260_1, 260_2 and 260_3 are turned on. In other example embodiments, the scan driving unit 530 may correspond to a typical scan driving unit performing a unidirectional scan from top to bottom.

The stages 510_1, 510_2 and 510_3 may provide the scan signals S(j−1), Sj and S(j+1) to pixel circuits 520_1, 520_2 and 520_3 included in a pixel array unit 540 through the scan lines S(j−1), Sj and S(j+1).

For example, a j-th stage (SRj) 510_2 of the scan driving unit 530 may receive an output signal S(j−1) of a previous stage, or a (j−1)-th stage (SR(j−1)) 510_1, may delay the output signal S(j−1) of the (j−1)-th stage (SR(j−1)) 510_1 by one horizontal time, and may output the delayed signal S(j−1) as an output signal Sj. The j-th stage (SRj) 510_2 may provide its output signal Sj to the corresponding scan line SLj and to a next stage, or a (j+1)-th stage (SR(j+1)) 510_3.

The (j+1)-th stage (SR(j+1)) 510_3 receiving the output signal Sn of the j-th stage (SRj) 510_2 may perform an operation similar to that of the j-th stage (SRj) 510_2 to generate an output signal S(j+1).

A pixel circuit 520_2 located at a j-th row may receive the scan signals S(j−1), Sj and S(j+1) in order of the (j−1)-th scan signal S(j−1), the j-th scan signal Sj and the (j+1)-th scan signal S(j+1), may perform an initialization operation in response to the j-th scan signal Sj, and may perform a data storing operation in response to the (j+1)-th scan signal S(j+1).

Figure 6:
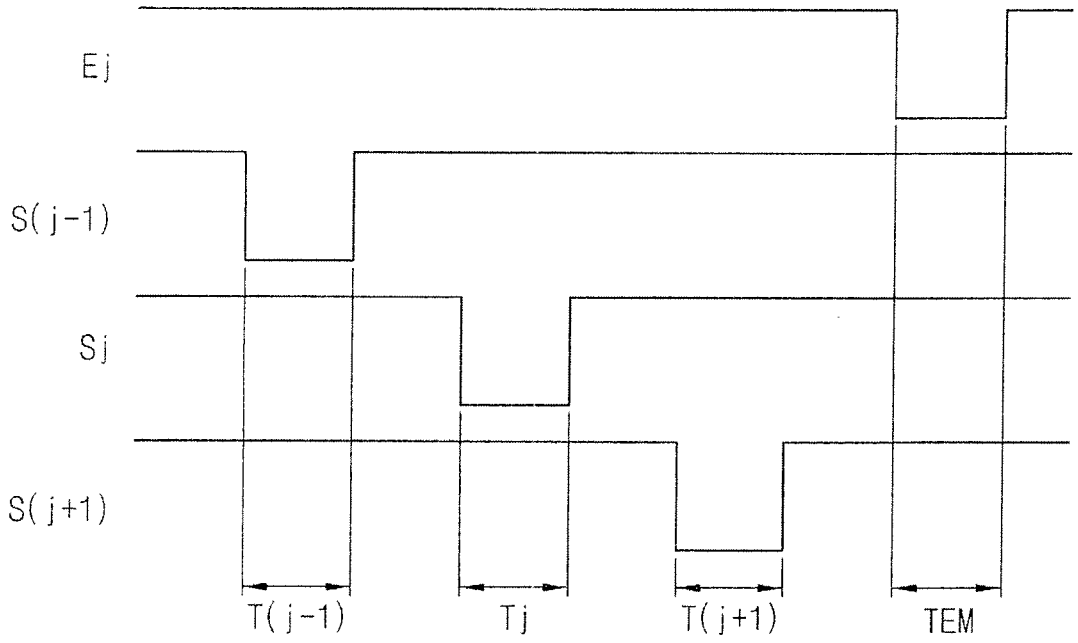
FIG. 6 is a timing diagram for describing an operation of a pixel circuit illustrated in FIG. 5.

FIG. 6 is a timing diagram for describing an operation of a pixel circuit illustrated in FIG. 5. FIG. 6 is a timing diagram illustrating an emission control signal Ej, a first scan signal Sj, a second scan signal S(j−1) and a third scan signal S(j+1) provided to a pixel circuit located corresponding to a j-th scan line, or a j-th emission control line.

Referring to FIG. 6, the second scan signal S(j−1) may be activated during a first time period T(j−1), the first scan signal Sj may be activated during a second time period Tj, the third scan signal S(j+1) may be activated during a third time period T(j+1), and the emission control signal Ej may be activated during a fourth time period TEM.

During the second time period Tj, the pixel circuit may initialize a storage capacitor in response to the activated first scan signal Sj. For example, a first switching unit including at least one PMOS transistor may be turned on in response to the first scan signal Sj having a low level, and the turned-on first switching unit may apply an initialization voltage to the storage capacitor to initialize the storage capacitor.

During the third time period T(j+1), the pixel circuit may store a data signal in the storage capacitor in response to the activated third scan signal S(j+1). For example, a second switching unit including at least one PMOS transistor may be turned on in response to the third scan signal S(j+1) having a low level, and the turned-on second switching unit may apply the data signal to a source terminal of a driving transistor. The driving transistor may be turned on in response to the initialization voltage stored in the storage capacitor, and the turned-on driving transistor may transfer the data signal from the source terminal to a drain terminal. A third switching unit may transfer the data signal from the drain terminal of the driving transistor to the storage capacitor to store the data signal in the storage capacitor, and may perform threshold voltage compensation by diode-connecting the driving transistor.

The pixel circuit may couple a data line to the storage capacitor during the first time period T(j−1) as well as the during the third time period T(j+1). However, because the storage capacitor is initialized during the second time period Tj, an operation of the pixel circuit during the first time period T(j−1) may not affect the data signal stored in storage capacitor during the third time period T(j+1).

During the fourth time period TEM, the pixel circuit emits light with luminance corresponding to the stored data signal in response to the activated emission control signal Ej. For example, at least one emission control transistor including at least one PMOS transistor may be turned on in response to the emission control signal Ej having a low level, and the turned on emission control transistor may form a current path from a high power supply voltage to a low power supply voltage. Thus, an organic light emitting diode included in the current path emits light with luminance corresponding to the data signal stored in the storage capacitor.

Figure 7:
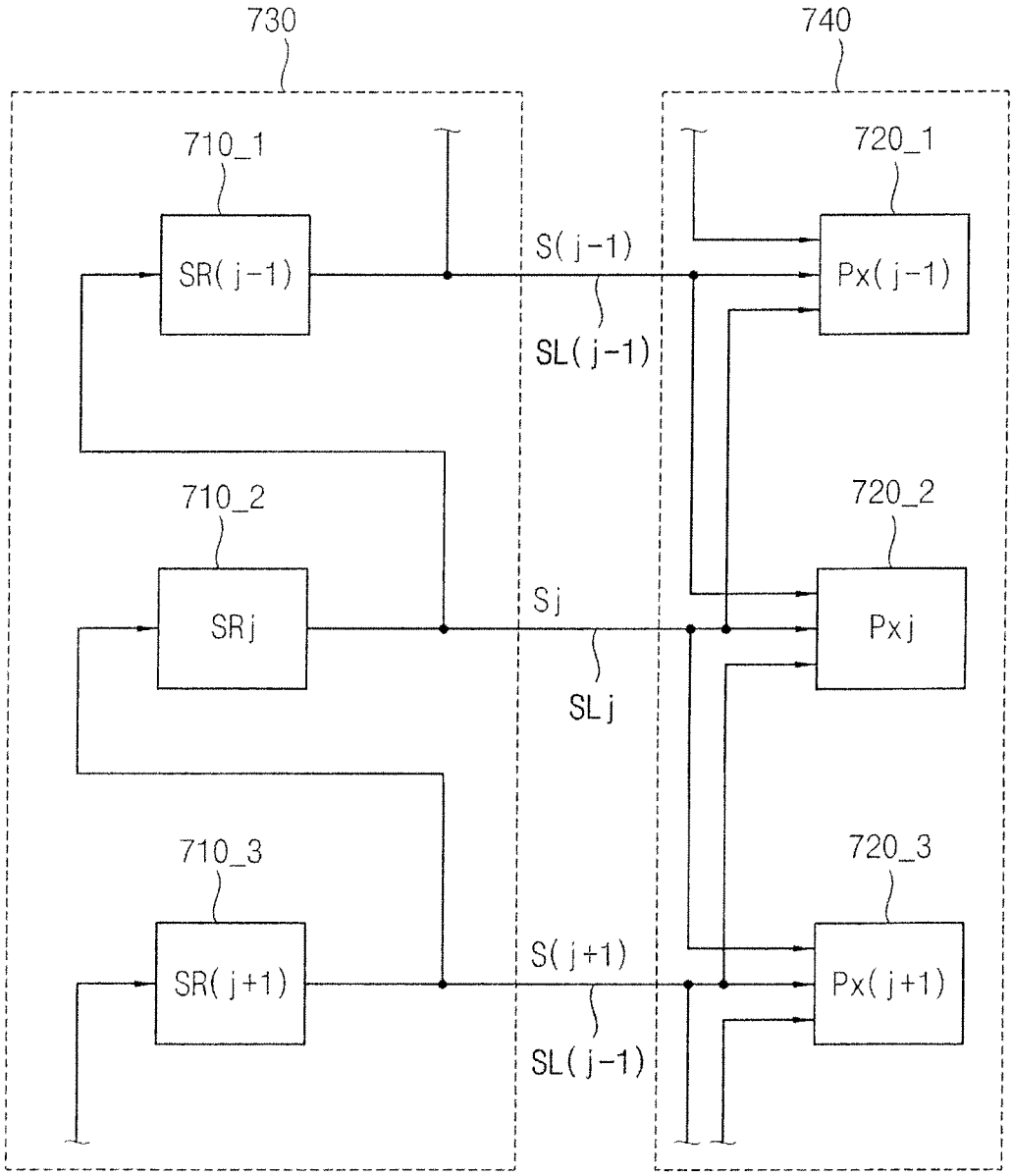
FIG. 7 is a block diagram illustrating a scan driving unit and a pixel array unit included in an organic light emitting display device in accordance with example embodiments.

FIG. 7 is a block diagram illustrating a scan driving unit and a pixel array unit included in an organic light emitting display device in accordance with example embodiments.

Referring to FIG. 7, a scan driving unit 730 may include a plurality of stages 710_1, 710_2 and 710_3 that are sequentially coupled in a direction from bottom to top.

In some example embodiments, the scan driving unit 730 illustrated in FIG. 7 may correspond to a scan driving unit 230 illustrated in FIG. 2 where first switches 250_1, 250_2 and 250_3 are turned on and second switches 260_1, 260_2 and 260_3 are turned off. In other example embodiments, the scan driving unit 730 may correspond to a typical scan driving unit performing a unidirectional scan from bottom to top.

The stages 710_1, 710_2 and 710_3 may provide the scan signals S(j−1), Sj and S(j+1) to pixel circuits 720_1, 720_2 and 720_3 included in a pixel array unit 740 through the scan lines S(j−1), Sj and S(j+1).

For example, a j-th stage (SRj) 710_2 of the scan driving unit 730 may receive an output signal S(j+1) of a previous stage, or a (j+1)-th stage (SR(j+1)) 710_3, may delay the output signal S(j+1) of the (j+1)-th stage (SR(j+1)) 710_3 by one horizontal time, and may output the delayed signal S(j+1) as an output signal Sj. The j-th stage (SRj) 710_2 may provide its output signal Sj to the corresponding scan line SLj and further to a next stage, or a (j−1)-th stage (SR(j−1)) 710_1.

The (j−1)-th stage (SR(j−1)) 710_1 receiving the output signal Sn of the j-th stage (SRj) 710_2 may perform an operation similar to that of the j-th stage (SRj) 710_2 to generate an output signal S(j−1).

A pixel circuit 720_2 located at a j-th row may receive the scan signals S(j−1), Sj and S(j+1) in order of the (j+1)-th scan signal S(j+1), the j-th scan signal Sj and the (j−1)-th scan signal S(j−1), may perform an initialization operation in response to the j-th scan signal Sj, and may perform a data storing operation in response to the (j−1)-th scan signal S(j−1).

Figure 8:
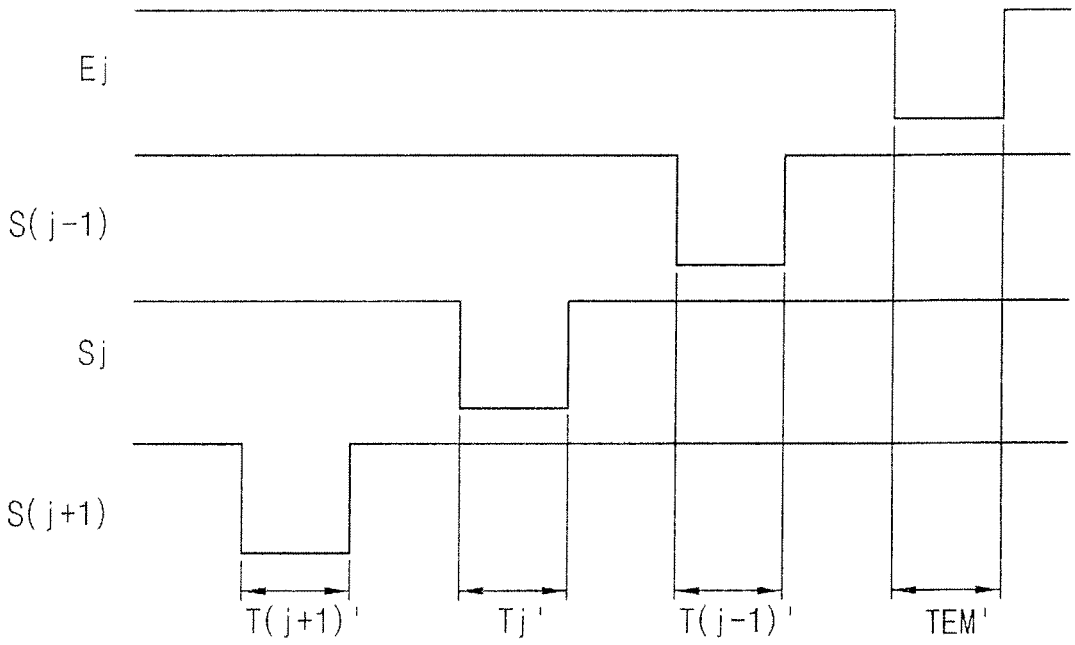
FIG. 8 is a timing diagram for describing an operation of a pixel circuit illustrated in FIG. 7.

FIG. 8 is a timing diagram for describing an operation of a pixel circuit illustrated in FIG. 7. For example, FIG. 8 is a timing diagram illustrating an emission control signal Ej, a first scan signal Sj, a second scan signal S(j−1) and a third scan signal S(j+1) provided to a pixel circuit corresponding to a j-th scan line, or a j-th emission control line.

Referring to FIG. 8, the third scan signal S(j+1) may be activated during a first time period T(j+1)', the first scan signal Sj may be activated during a second time period Tj', the second scan signal S(j−1) may be activated during a third time period T(j−1)', and the emission control signal Ej may be activated during a fourth time period TEM'.

During the second time period Tj', the pixel circuit may initialize a storage capacitor in response to the activated first scan signal Sj. For example, a first switching unit including at least one PMOS transistor may be turned on in response to the first scan signal Sj having a low level, and the turned-on first switching unit may apply an initialization voltage to the storage capacitor to initialize the storage capacitor.

During the third time period T(j−1)', the pixel circuit may store a data signal in the storage capacitor in response to the activated second scan signal S(j−1). For example, a second switching unit including at least one PMOS transistor may be turned on in response to the second scan signal S(j−1) having a low level, and the turned-on second switching unit may apply the data signal to a source terminal of a driving transistor. The driving transistor may be turned on in response to the initialization voltage stored in the storage capacitor, and the turned-on driving transistor may transfer the data signal from the source terminal to a drain terminal. A third switching unit may transfer the data signal from the drain terminal of the driving transistor to the storage capacitor to store the data signal in the storage capacitor, and may perform threshold voltage compensation by diode-connecting the driving transistor.

The pixel circuit may couple a data line to the storage capacitor during the first time period T(j+1)' as well as the during the third time period T(j−1)'. However, because the storage capacitor is initialized during the second time period Tj', an operation of the pixel circuit during the first time period T(j+1)' may not affect the data signal stored in storage capacitor during the third time period T(j−1)'.

During the fourth time period TEM', the pixel circuit emits light with luminance corresponding to the stored data signal in response to the activated emission control signal Ej. For example, at least one emission control transistor including at least one PMOS transistor may be turned on in response to the emission control signal Ej having a low level, and the turned on emission control transistor may form a current path from a high power supply voltage to a low power supply voltage. Thus, an organic light emitting diode included in the current path emits light with luminance corresponding to the data signal stored in the storage capacitor.

Figure 9:
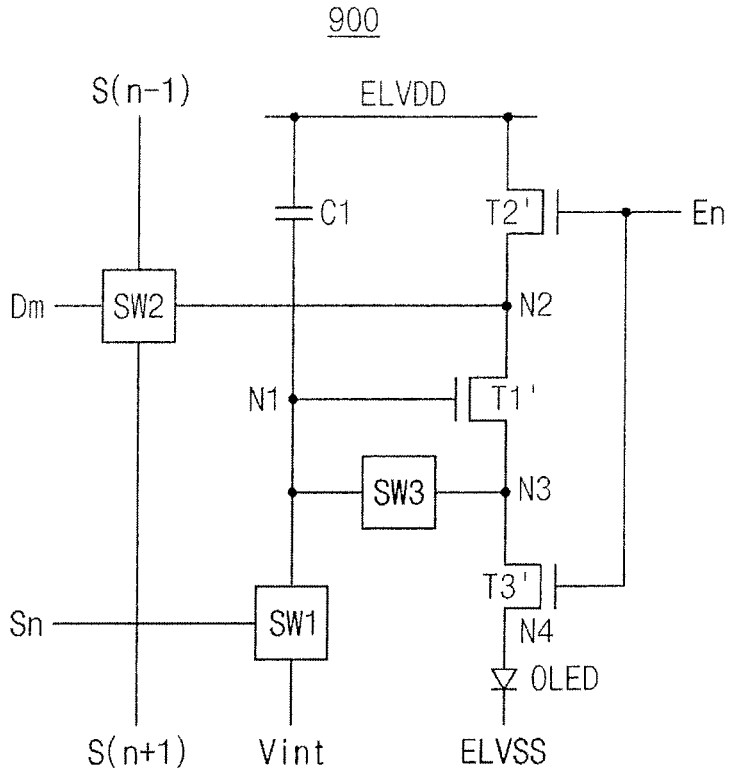
FIG. 9 is a circuit diagram illustrating a pixel circuit of an organic light emitting display device in accordance with example embodiments.

FIG. 9 is a circuit diagram illustrating a pixel circuit of an organic light emitting display device in accordance with example embodiments. FIG. 9 illustrates a pixel circuit 900 corresponding to an m-th data line, an n-th scan line and an n-th emission control line.

Referring to FIG. 9, the pixel circuit 900 of the organic light emitting display device may include a storage capacitor C1, a first switching unit SW1, a second switching unit SW2, a third switching unit SW3, a driving transistor T1', a first emission control transistor T2', a second emission control transistor T3' and an organic light emitting diode OLED. The storage capacitor C1 may have a first electrode coupled to a high power supply voltage ELVDD and a second electrode coupled to a first node N1. The first switching unit SW1 may have a first terminal coupled to an initialization voltage Vint and a second terminal coupled to the first node N1, and may be controlled by a first scan signal Sn applied through a first scan line. The second switching unit SW2 may have a first terminal coupled to a data line through which a data signal Dm is applied and a second terminal coupled to a second node N2, and may be controlled by one of a second scan signal S(n−1) applied through a second scan line and a third scan signal S(n+1) applied through a third scan line. The third switching unit SW3 may have a first terminal coupled to the first node N1 and a second terminal coupled to a third node N3. The driving transistor T1' may be implemented with an NMOS transistor having a gate terminal coupled to the first node N1, a drain terminal coupled to the second node N2, and a source terminal coupled to the third node N3. The first emission control transistor T2' may be implemented with an NMOS transistor having a gate terminal coupled to an emission control line through which an emission control signal En is applied, a drain terminal coupled to the high power supply voltage ELVDD, and a source coupled to the second node N2. The second emission control transistor T3' may be implemented with an NMOS transistor having a gate terminal coupled to the emission control line through which the emission control signal En is applied, a drain terminal coupled to the third node N3, and a source terminal coupled to a fourth node N4. The organic light emitting diode OLED may have an anode electrode coupled to the fourth node N4 and a cathode electrode coupled to a low power supply voltage ELVSS.

The first switching unit SW1 may initialize the storage capacitor C1 by applying the initialization voltage Vint to the first node N1 in response to the first scan signal Sn applied through the first scan line.

In a case where a scan driving unit included in the organic light emitting display device performs a first unidirectional scan that sequentially applies the scan signals S(n−1), Sn and S(n+1) to the scan lines in a first direction from the bottommost scan line to the topmost scan line, or in a case where the first through third scan signals S(n−1), Sn and S(n+1) are activated in order of the third scan signal S(n+1) applied through the third scan line, the first scan signal Sn applied through the first scan line disposed in the first direction from the third scan line, and the second scan signal S(n−1) applied through the second scan line disposed in the first direction from the first scan line, the second switching unit SW2 may be turned on in response to the second scan signal S(n−1), which is activated after the first scan signal Sn is activated, to store the data signal Dm in the storage capacitor C1.

In a case where the scan driving unit performs a second unidirectional scan that sequentially applies the scan signals S(n−1), Sn and S(n+1) to the scan lines in a second direction from the topmost scan line to the bottommost scan line, or in a case where the first through third scan signals S(n−1), Sn and S(n+1) are activated in order of the second scan signal S(n−1) applied through the second scan line, the first scan signal Sn applied through the first scan line disposed in the second direction from the second scan line, and the third scan signal S(n+1) applied through the third scan line disposed in the second direction from the first scan line, the second switching unit SW2 may be turned on in response to the third scan signal S(n+1), which is activated after the first scan signal Sn is activated, to store the data signal Dm in the storage capacitor C1.

That is, the second switching unit SW2 may receive the second scan signal S(n−1) applied through the second scan line disposed in the first direction from the first scan line, and may further receive the third scan signal S(n+1) applied through the third scan line disposed in the second direction opposite to the first direction from the first scan line, and may transfer the data signal Dm from the data line to the second node N2 in response to one of the second scan signal S(n−1) and the third scan signal S(n+1) that is activated after the first scan signal Sn is activated.

The driving transistor T1' may be turned on in response to the initialization voltage Vint stored in the storage capacitor C1, and the turned-on driving transistor T1' may transfer the data signal Dm from the second node N2 to the third node N3.

The third switching unit SW3 may store the data signal Dm in the storage capacitor C1 by transferring the data signal Dm from the third node N3 to the first node N1, and may perform threshold voltage compensation by diode-connecting the driving transistor T1'.

The first emission control transistor T2' may be turned off to decouple the second node N2 from the high power supply voltage ELVDD until the data signal Dm is stored in the storage capacitor C1.

The second emission control transistor T3' may be turned off to decouple the third node N3 from the fourth node N4 until the data signal Dm is stored in the storage capacitor C1.

After the data signal Dm is stored in the storage capacitor C1, the first and second emission control transistors T2' and T3' may be turned on in response to the emission control signal En applied through the emission control line. While the first and second emission control transistors T2' and T3' are turned on, the organic light emitting diode OLED may emit light based on a driving current generated by the driving transistor T1' in response to the data signal Dm stored in the storage capacitor C1.

As described above, the pixel circuit 900 according to example embodiments may initialize the storage capacitor C1 in response to the first scan signal Sn. When the scan driving unit performs the first unidirectional scan from bottom to top, the pixel circuit 900 may store the data signal Dm in the storage capacitor C1 through the second switching unit SW2, the driving transistor T1' and the third switching unit SW3 in response to the second scan signal S(n−1) that is activated after the first scan signal Sn is activated. Further, when the scan driving unit performs the second unidirectional scan from top to bottom, the pixel circuit 900 may store the data signal Dm in the storage capacitor C1 through the second switching unit SW2, the driving transistor T1' and the third switching unit SW3 in response to the third scan signal S(n+1) that is activated after the first scan signal Sn is activated. Thus, the pixel circuit 900 according to example embodiments may perform the initialization operation, the data storing operation, the light emitting operation, etc. in either case where the first unidirectional scan from bottom to top or the second unidirectional scan from top to bottom is performed. That is, the pixel circuit 900 according to example embodiments may operate in any case (e.g., where the first unidirectional scan from bottom to top, the second unidirectional scan from top to bottom, or the bidirectional scan is performed).

Figure 10:
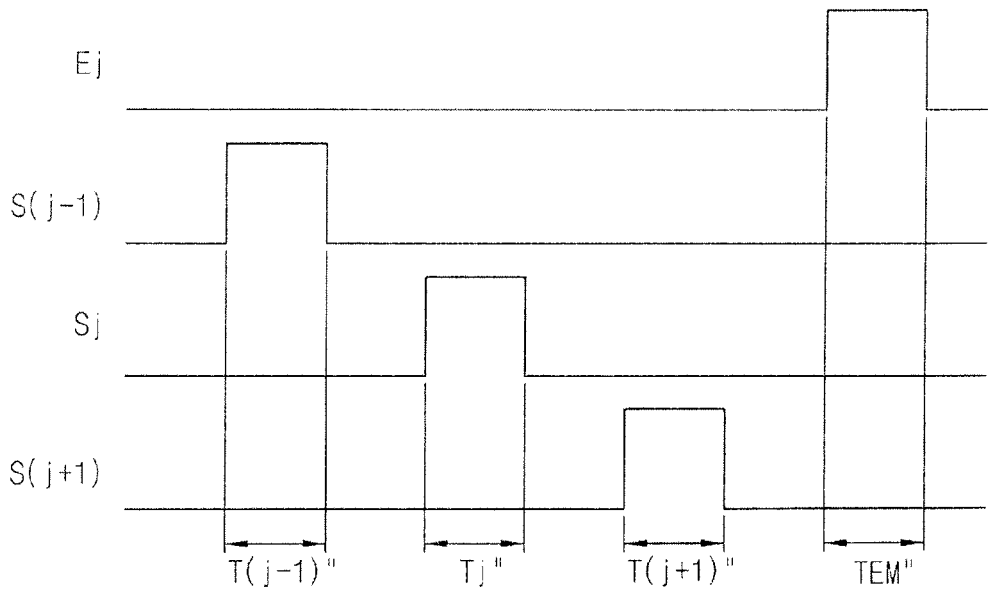
FIG. 10 is a timing diagram for describing an example of an operation of a pixel circuit illustrated in FIG. 9.

FIG. 10 is a timing diagram for describing an example of an operation of a pixel circuit illustrated in FIG. 9. For example, FIG. 10 is a timing diagram illustrating an emission control signal Ej, a first scan signal Sj, a second scan signal S(j−1) and a third scan signal S(j+1) provided to a pixel circuit located corresponding to a j-th scan line, or a j-th emission control line.

Referring to FIG. 1, the second scan signal S(j−1) may be activated during a first time period T(j−1)", the first scan signal Sj may be activated during a second time period Tj", the third scan signal S(j+1) may be activated during a third time period T(j+1)", and the emission control signal Ej may be activated during a fourth time period TEM".

During the second time period Tj", the pixel circuit may initialize a storage capacitor in response to the activated first scan signal Sj. For example, a first switching unit including at least one NMOS transistor may be turned on in response to the first scan signal Sj having a high level, and the turned-on first switching unit may apply an initialization voltage to the storage capacitor to initialize the storage capacitor.

During the third time period T(j+1)", the pixel circuit may store a data signal in the storage capacitor in response to the activated third scan signal S(j+1). For example, a second switching unit including at least one NMOS transistor may be turned on in response to the third scan signal S(j+1) having a high level, and the turned-on second switching unit may apply the data signal to a drain terminal of a driving transistor. The driving transistor may be turned on in response to the initialization voltage stored in the storage capacitor, and the turned-on driving transistor may transfer the data signal from the drain terminal to a source terminal. A third switching unit may transfer the data signal from the source terminal of the driving transistor to the storage capacitor to store the data signal in the storage capacitor, and may perform threshold voltage compensation by diode-connecting the driving transistor.

The pixel circuit may couple a data line to the storage capacitor during the first time period T(j−1)" as well as the during the third time period T(j+1)". However, because the storage capacitor is initialized during the second time period Tj", an operation of the pixel circuit during the first time period T(j−1)" may not affect the data signal stored in storage capacitor during the third time period T(j+1)".

During the fourth time period TEM", the pixel circuit emits light with luminance corresponding to the stored data signal in response to the activated emission control signal Ej. For example, at least one emission control transistor including at least one NMOS transistor may be turned on in response to the emission control signal Ej having a high level, and the turned on emission control transistor may form a current path from a high power supply voltage to a low power supply voltage. Thus, an organic light emitting diode included in the current path may emit light with luminance corresponding to the data signal stored in the storage capacitor.

Figure 11:
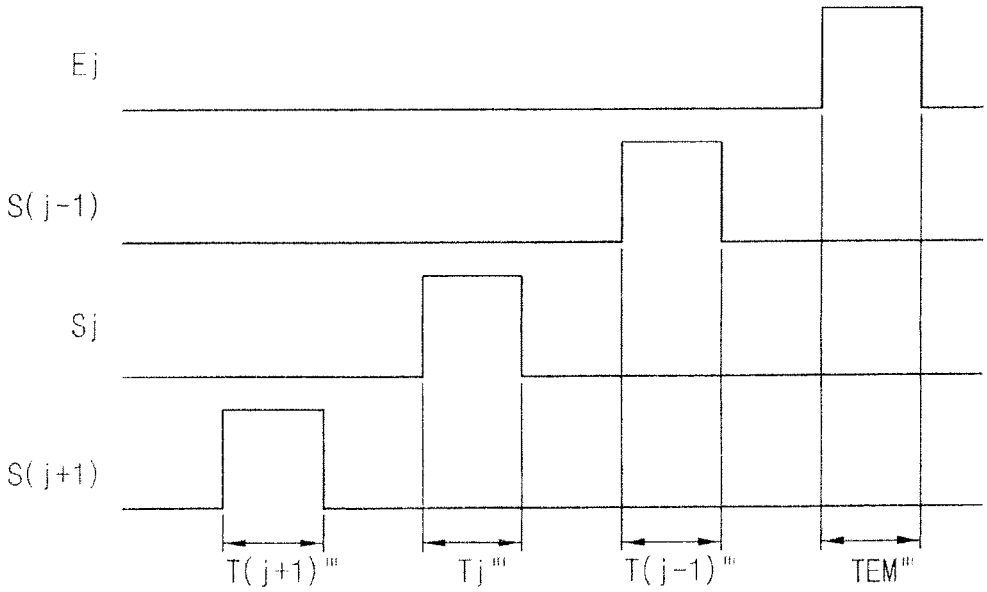
FIG. 11 is a timing diagram for describing another example of an operation of a pixel circuit illustrated in FIG. 9.

FIG. 11 is a timing diagram for describing another example of an operation of a pixel circuit illustrated in FIG. 9. FIG. 11 is a timing diagram illustrating an emission control signal Ej, a first scan signal Sj, a second scan signal S(j−1) and a third scan signal S(j+1) provided to a pixel circuit located corresponding to a j-th scan line, or a j-th emission control line.

Referring to FIG. 11, the third scan signal S(j+1) may be activated during a first time period T(j+1)'", the first scan signal Sj may be activated during a second time period Tj'", the second scan signal S(j−1) may be activated during a third time period T(j−1)'", and the emission control signal Ej may be activated during a fourth time period TEM'".

During the second time period Tj'", the pixel circuit may initialize a storage capacitor in response to the activated first scan signal Sj. For example, a first switching unit including at least one NMOS transistor may be turned on in response to the first scan signal Sj having a high level, and the turned-on first switching unit may apply an initialization voltage to the storage capacitor to initialize the storage capacitor.

During the third time period T(j−1)'", the pixel circuit may store a data signal in the storage capacitor in response to the activated second scan signal S(j−1). For example, a second switching unit including at least one NMOS transistor may be turned on in response to the second scan signal S(j−1) having a high level, and the turned-on second switching unit may apply the data signal to a drain terminal of a driving transistor. The driving transistor may be turned on in response to the initialization voltage stored in the storage capacitor, and the turned-on driving transistor may transfer the data signal from the drain terminal to a source terminal. A third switching unit may transfer the data signal from the source terminal of the driving transistor to the storage capacitor to store the data signal in the storage capacitor, and may perform threshold voltage compensation by diode-connecting the driving transistor.

The pixel circuit may couple a data line to the storage capacitor during the first time period T(j+1)'" as well as the during the third time period T(j−1)'". However, because the storage capacitor is initialized during the second time period Tj'", an operation of the pixel circuit during the first time period T(j+1)'" may not affect the data signal stored in storage capacitor during the third time period T(j−1)'".

During the fourth time period TEM'", the pixel circuit emits light with luminance corresponding to the stored data signal in response to the activated emission control signal Ej. For example, at least one emission control transistor including at least one NMOS transistor may be turned on in response to the emission control signal Ej having a high level, and the turned on emission control transistor may form a current path from a high power supply voltage to a low power supply voltage. Thus, an organic light emitting diode included in the current path may emit light with luminance corresponding to the data signal stored in the storage capacitor.

Figure 12:
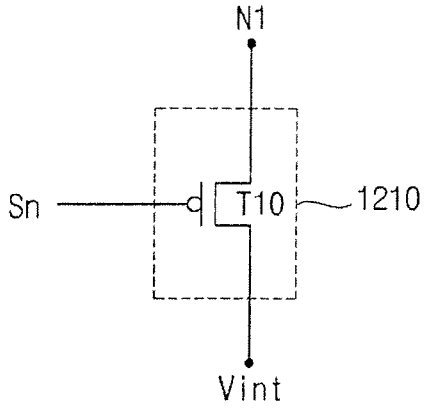
FIG. 12 is a circuit diagram illustrating an example of a first switching unit included in a pixel circuit of an organic light emitting display device in accordance with example embodiments.

FIG. 12 is a circuit diagram illustrating an example of a first switching unit included in a pixel circuit of an organic light emitting display device in accordance with example embodiments.

Referring to FIG. 12, a first switching unit 1210 may include a first PMOS transistor T10 having a first terminal coupled to a first node N1, a second terminal coupled to an initialization voltage Vint, and a gate terminal to which a first scan signal Sn is applied.

The first PMOS transistor T10 may apply the initialization voltage Vint to a storage capacitor by being turned on in response to the first scan signal Sn.

Figure 13:
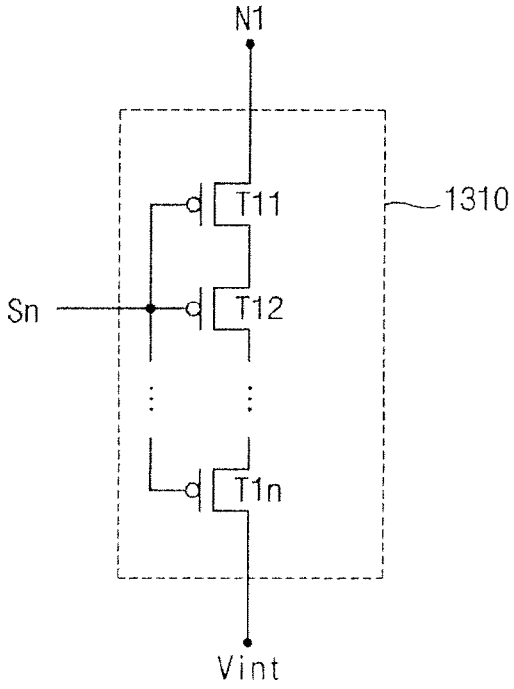
FIG. 13 is a circuit diagram illustrating another example of a first switching unit included in a pixel circuit of an organic light emitting display device in accordance with example embodiments.

FIG. 13 is a circuit diagram illustrating another example of a first switching unit included in a pixel circuit of an organic light emitting display device in accordance with example embodiments.

Referring to FIG. 13, a first switching unit 1310 may include a plurality of first PMOS transistors T11, T12 and T1*n* connected in series between a first node N1 and an initialization voltage Vint. Each first PMOS transistor T11, T12 and T1*n* may be turned on in response to a first scan signal Sn.

The plurality of serially connected first PMOS transistors T11, T12 and T1*n* may apply the initialization voltage Vint to a storage capacitor by being turned on in response to the first scan signal Sn.

Figure 14:
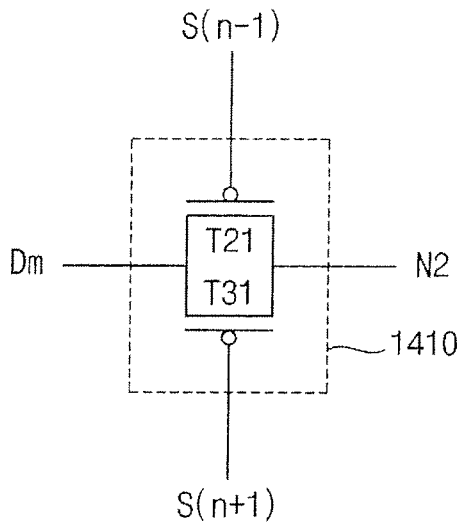
FIG. 14 is a circuit diagram illustrating an example of a second switching unit included in a pixel circuit of an organic light emitting display device in accordance with example embodiments.

FIG. 14 is a circuit diagram illustrating an example of a second switching unit included in a pixel circuit of an organic light emitting display device in accordance with example embodiments.

Referring to FIG. 14, a second switching unit 1410 may include a second PMOS transistor T21 having a first terminal coupled to a data line through which a data signal Dm is applied, a second terminal coupled to a second node N2 and a gate terminal to which a second scan signal S(n−1) is applied, and a third PMOS transistor T31 having a first terminal coupled to the data line through which the data signal Dm is applied, a second terminal coupled to the second node N2 and a gate terminal to which a third scan signal S(n+1) is applied.

The second PMOS transistor T21 may transfer the data signal Dm from the data line to the second node N2 in response to the second scan signal S(n−1), and the third PMOS transistor T31 may transfer the data signal Dm from the data line to the second node N2 in response to the third scan signal S(n+1).

Figure 15:
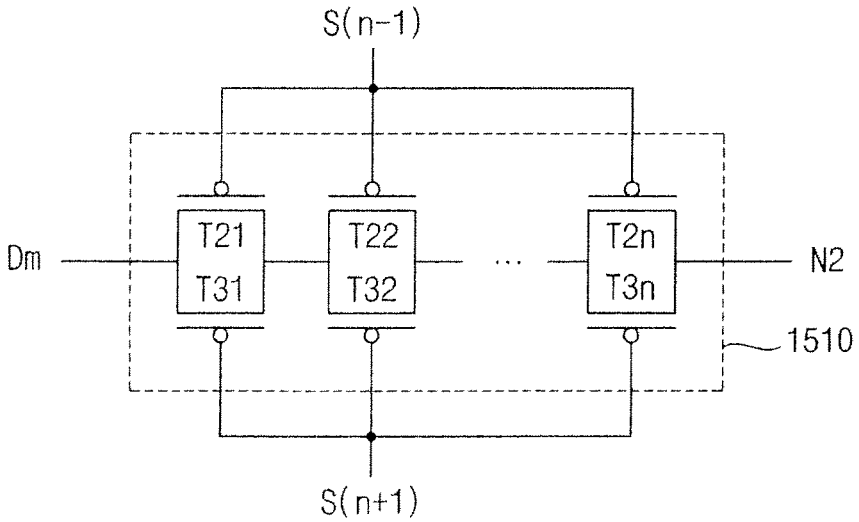
FIG. 15 is a circuit diagram illustrating another example of a second switching unit included in a pixel circuit of an organic light emitting display device in accordance with example embodiments.

FIG. 15 is a circuit diagram illustrating another example of a second switching unit included in a pixel circuit of an organic light emitting display device in accordance with example embodiments.

Referring to FIG. 15, a second switching unit 1510 may include a plurality of second PMOS transistors T21, T22 and T2*n* connected in series between a data line and a second node N2, and a plurality of third PMOS transistors T31, T32 and T3*n* connected in series between the data line and the second node N2.

The plurality of serially connected second PMOS transistors T21, T22 and T2*n* may transfer a data signal Dm from the data line to the second node N2 in response to the second scan signal S(n−1), and the plurality of serially connected third PMOS transistors T31, T32 and T3*n* may transfer the data signal Dm from the data line to the second node N2 in response to the third scan signal S(n+1). Each of the plurality of second PMOS transistors T21, T22 and T2*n* may be connected in parallel with a corresponding one of the plurality of third PMOS transistors T31, T32 and T3*n*.

Figure 16:
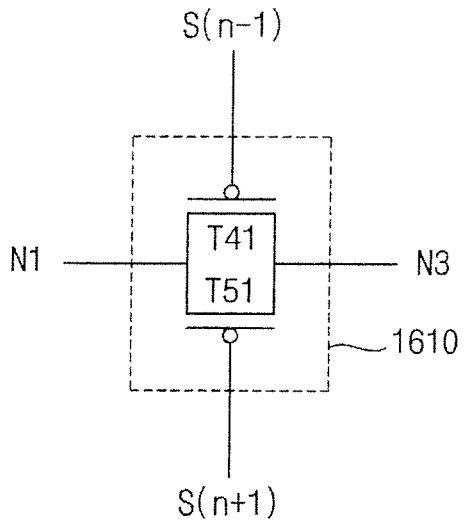
FIG. 16 is a circuit diagram illustrating an example of a third switching unit included in a pixel circuit of an organic light emitting display device in accordance with example embodiments.

FIG. 16 is a circuit diagram illustrating an example of a third switching unit included in a pixel circuit of an organic light emitting display device in accordance with example embodiments.

Referring to FIG. 16, a third switching unit 1610 may include a fourth PMOS transistor T41 having a first terminal coupled to a third node N3, a second terminal coupled to a first node N1 and a gate terminal to which a second scan signal S(n−1) is applied, and a fifth PMOS transistor T51 having a first terminal coupled to the third node N3, a second terminal coupled to the first node N1 and a gate terminal to which a third scan signal S(n+1) is applied.

The fourth PMOS transistor T41 may store a data signal in a storage capacitor by transferring the data signal from the third node N3 to the first node N1 in response to the second scan signal S(n−1), and the fifth PMOS transistor T51 may store the data signal in the storage capacitor by transferring the data signal from the third node N3 to the first node N1 in response to the third scan signal S(n+1).

Figure 17:
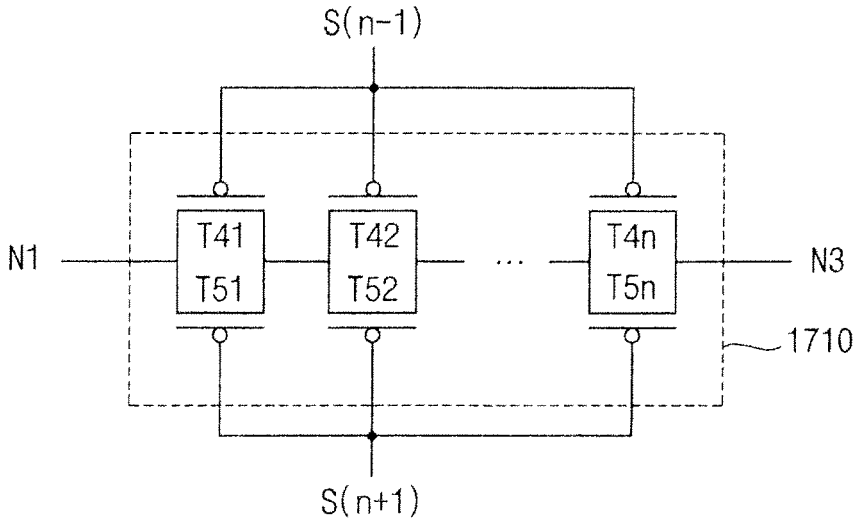
FIG. 17 is a circuit diagram illustrating another example of a third switching unit included in a pixel circuit of an organic light emitting display device in accordance with example embodiments.

FIG. 17 is a circuit diagram illustrating another example of a third switching unit included in a pixel circuit of an organic light emitting display device in accordance with example embodiments.

Referring to FIG. 17, a third switching unit 1710 may include a plurality of fourth PMOS transistors T41, T42 and T4*n* connected in series between a third node N3 and a first node N1, and a plurality of fifth PMOS transistors T51, T52 and T5*n* connected in series between the third node N3 and the first node N1

The plurality of serially connected fourth PMOS transistors T41, T42 and T4*n* may store a data signal in a storage capacitor by transferring the data signal from the third node N3 to the first node N1 in response to the second scan signal S(n−1), and the plurality of serially connected fifth PMOS transistors T51, T52 and T5*n* may store the data signal in the storage capacitor by transferring the data signal from the third node N3 to the first node N1 in response to the third scan signal S(n+1). Each of the plurality of fourth PMOS transistors T41, T42 and T4*n* may be connected in parallel with a corresponding one of the plurality of fifth PMOS transistors T51, T52 and T5*n*.

Figure 18:
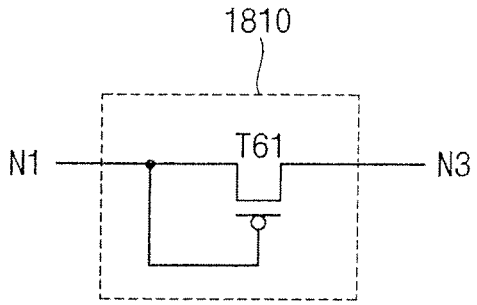
FIG. 18 is a circuit diagram illustrating still another example of a third switching unit included in a pixel circuit of an organic light emitting display device in accordance with example embodiments.

FIG. 18 is a circuit diagram illustrating still another example of a third switching unit included in a pixel circuit of an organic light emitting display device in accordance with example embodiments.

Referring to FIG. 18, a third switching unit 1810 may include a diode-connected transistor T61 between a third node N3 and a first node N1. For example, the diode-connected transistor T61 may have an anode coupled to the third node N3 and a cathode coupled to the first node N1.

When a data signal is stored in a storage capacitor, a voltage level of the third node N3 coupled to the anode may be higher than that of the first node N1 coupled to the cathode, and the third switching unit 1810 may be turned on. When a first scan signal is applied or when an emission control signal is applied, the voltage level of the third node N3 coupled to the anode may be lower than that of the first node N1 coupled to the cathode, and the third switching unit 1810 may be turned off.

Although FIGS. 12 through 18 illustrate examples where PMOS transistors are used, in some example embodiments, at least one NMOS transistor may be used.

Figure 19:
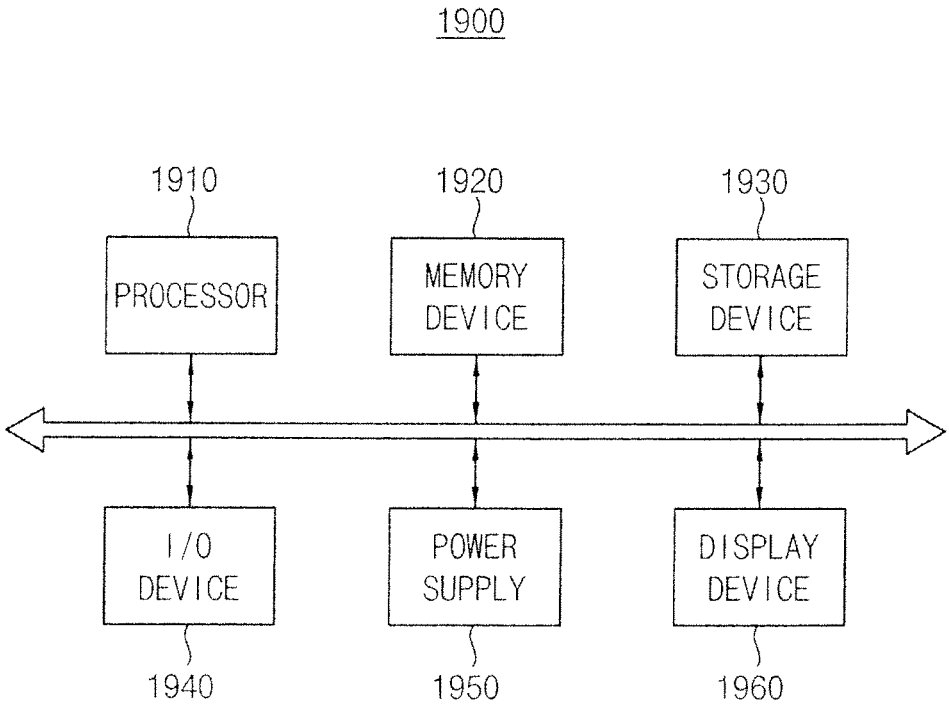
FIG. 19 is a block diagram illustrating an electronic system including an organic light emitting display device in accordance with example embodiments.

FIG. 19 is a block diagram illustrating an electronic system including an organic light emitting display device in accordance with example embodiments.

Referring to FIG. 19, an electronic system 1900 includes a processor 1910, a memory device 1920, a storage device 1930, an input/output (I/O) device 1940, a power supply 1950, and an organic light emitting display device 1960. The organic light emitting display device 1960 may correspond to an organic light emitting display device 100 of FIG. 1. The electronic system 1000 may further include a plurality of ports for communicating a video card, a sound card, a memory card, a universal serial bus (USB) device, other electronic systems, etc.

The processor 1910 may perform various computing functions or tasks. The processor 1910 may be for example, a microprocessor, a central processing unit (CPU), etc. The processor 1910 may be connected to other components via an address bus, a control bus, a data bus, etc. Further, the processor 1910 may be coupled to an extended bus such as a peripheral component interconnection (PCI) bus.

The memory device 1920 may store data for operations of the electronic system 1900. For example, the memory device 1920 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1930 may be, for example, a solid state drive (SSD) device, a hard disk drive (HDD) device, a CD-ROM device, etc. The I/O device 1940 may be, for example, an input device such as a keyboard, a keypad, a mouse, a touch screen, etc, and/or an output device such as a printer, a speaker, etc. The power supply 1950 may supply power for operations of the electronic system 1900. The organic light emitting display device 1960 may communicate with other components via the buses or other communication links.

The organic light emitting display device 1960 may include a pixel circuit 300 illustrated in FIG. 3, a pixel circuit 400 illustrated in FIG. 4 or a pixel circuit 900 illustrated in FIG. 9, or the like. The pixel circuit 300, 400 and 900 included in the organic light emitting display device 1960 may be readily driven by a bidirectional scan. In some example embodiments, the organic light emitting display device 1960 may include a scan driving unit that can perform the bidirectional scan using a single shift register, and thus the organic light emitting display device 1960 may have a narrow bezel.

The present embodiments may be applied to any electronic system 1900 having an organic light emitting display device. For example, the present embodiments may be applied to the electronic system 1900, such as a television, a computer monitor, a laptop, a tablet computer, a digital camera, a cellular phone, a smart phone, a personal digital assistant (PDA), a portable multimedia player (PMP), a MP3 player, a navigation system, a video phone, etc.

The foregoing is illustrative of example embodiments, and is not to be construed as limiting thereof. Although a few example embodiments have been described, those skilled in the art will readily appreciate that many modifications are possible without materially departing from the spirit and scope of the present invention. The present invention is defined by the following claims, with equivalents of the claims to be included therein.

What is claimed is:

1. A pixel circuit of an organic light emitting device, comprising:

a storage capacitor;

a first switching unit configured to initialize the storage capacitor in response to a first scan signal received from a first scan line;

a second switching unit configured to receive a second scan signal from a second scan line disposed in a first direction from the first scan line, to receive a third scan signal from a third scan line disposed in a second direction opposite to the first direction from the first scan line, and configured to be turned on in response to one of the second scan signal and the third scan signal that is activated after the first scan signal is activated to store a data signal in the storage capacitor;

a driving transistor configured to provide a driving current according to the data signal stored in the storage capacitor; and an organic light emitting diode configured to emit light in response to the driving current, wherein the second switching unit comprises:

a second transistor configured to couple a data line through which the data signal is received to a first terminal of the driving transistor in response to the second scan signal; and a third transistor configured to couple the data line to the first terminal of the driving transistor in response to the third scan signal.

2. The pixel circuit of claim 1, wherein, when the first scan signal, the second scan signal, and the third scan signal are sequentially activated in order of the second scan signal applied through the second scan line, the first scan signal applied through the first applied through the third scan line disposed in the second direction from the first scan line, the second switching unit is configured to turn on in response to the third scan signal to store the data signal in the storage capacitor.

3. The pixel circuit of claim 1, wherein, when the first scan signal, the second scan signal, and the third scan signal are sequentially activated in order of the third scan signal applied through the third scan line, the first scan signal applied through the first scan line disposed in the first direction from the third scan line, and the second scan signal applied through the second scan line disposed in the first direction from the first scan line, the second switching unit is configured to turn on in response to the second scan signal to store the data signal in the storage capacitor.

4. The pixel circuit of claim 1, wherein the first switching unit comprises:

a first transistor configured to apply an initialization voltage to the storage capacitor in response to the first scan signal.

5. The pixel circuit of claim 1, wherein the first switching unit comprises:

a plurality of first transistors connected in series, the plurality of first transistors configured to apply an initialization voltage to the storage capacitor in response to the first scan signal.

6. The pixel circuit of claim 1, wherein the second transistor comprises a plurality of second transistors connected in series, wherein the third transistor comprises a plurality of third transistors connected in series, and wherein each of the plurality of second transistors is connected in parallel with a corresponding one of the plurality of third transistors.

7. The pixel circuit of claim 1, further comprising:

a third switching unit configured to couple a second terminal of the driving transistor to the storage capacitor, wherein, when the second switching unit is turned on, the second switching unit is configured to transfer the data signal to a first terminal of the driving transistor, the driving transistor is configured to transfer the data signal from the first terminal thereof to the second terminal thereof, and the third switching unit is configured to transfer the data signal from the second terminal of the driving transistor to the storage capacitor.

8. The pixel circuit of claim 7, wherein the third switching unit comprises:

a fourth transistor configured to couple the second terminal of the driving transistor to the storage capacitor in response to the second scan signal; and a fifth transistor configured to couple the second terminal of the driving transistor to the storage capacitor in response to the third scan signal.

9. The pixel circuit of claim 7, wherein the third switching unit comprises:

a plurality of fourth transistors connected in series, the plurality of fourth transistors configured to couple the second terminal of the driving transistor to the storage capacitor in response to the second scan signal; and a plurality of fifth transistors connected in series, the plurality of fifth transistors configured to couple the second terminal of the driving transistor to the storage capacitor in response to the third scan signal, wherein each of the plurality of fourth transistors is connected in parallel with a corresponding one of the plurality of fifth transistors.

10. The pixel circuit of claim 7, wherein the third switching unit comprises:

a diode-connected transistor coupled between the second terminal of the driving transistor and the storage capacitor.

11. The pixel circuit of claim 1, further comprising:

a first emission control transistor configured to couple a power supply to the driving transistor in response to an emission control signal; and a second emission control transistor configured to couple the driving transistor to the organic light emitting diode in response to the emission control signal.

12. The pixel circuit of claim 1, wherein at least one of the driving transistor, the first switching unit, and the second switching unit comprises a PMOS transistor.

13. The pixel circuit of claim 1, wherein at least one of the driving transistor, the first switching unit, and the second switching unit comprises an NMOS transistor.

14. A pixel circuit of an organic light emitting device, comprising:

a storage capacitor comprising a first electrode coupled to a first node and a second electrode coupled to a power supply;

a first transistor having a first terminal directly coupled to the first node, a second terminal coupled to an initialization voltage power supply, and a gate terminal coupled to a first scan line;

a second transistor having a first terminal coupled to a data line, a second terminal directly coupled to a second node, and a gate terminal coupled to a second scan line;

a third transistor having a first terminal directly coupled to the data line, a second terminal directly coupled to the second node, and a gate terminal coupled to a third scan line;

a driving transistor having a first terminal coupled to the second node, a second terminal coupled to a third node, and a gate terminal directly coupled to the first node;

a fourth transistor having a first terminal coupled to the third node, a second terminal coupled to the first node, and a gate terminal directly coupled to the second scan line;

a fifth transistor having a first terminal coupled to the third node, a second terminal coupled to the first node, and a gate terminal coupled to the third scan line; and an organic light emitting diode configured to emit light in response to a driving current received from the driving transistor.

15. The pixel circuit of claim 14, wherein the second scan line is disposed in a first direction from the first scan line, and the third scan line is disposed in a second direction opposite to the first direction from the first scan line, wherein a first scan signal, a second scan signal, and a third scan signal are received from the first scan line, the third scan line, and the third scan line, respectively, and wherein, when the first scan signal, the second scan signal, and the third scan signal are sequentially activated in order of the second scan signal applied through the second scan line, the first scan signal applied through the first scan line disposed in the second direction from the second scan line, and the third scan signal applied through the third scan line disposed in the second direction from the first scan line, the data line is configured to be coupled to the storage capacitor through the third transistor, the driving transistor, and the fifth transistor.

16. The pixel circuit of claim 14, wherein the second scan line is disposed in a first direction from the first scan line, and the third scan line is disposed in a second direction opposite to the first direction from the first scan line, wherein a first scan signal, a second scan signal, and a third scan signal are applied through the first scan line, the second scan line, and the third scan line, respectively, and wherein, when the first scan signal, the second scan signal, and the third scan signal are sequentially activated in order of the third scan signal applied through the third scan line, the first scan signal applied through the first scan line disposed in the first direction from the third scan line, and the second scan signal applied through the second scan line disposed in the first direction from the first scan line, the data line is configured to be coupled to the storage capacitor through the second transistor, the driving transistor, and the fourth transistor.

17. The pixel circuit of claim 14, further comprising:

a first emission control transistor having a first terminal coupled to the power supply, a second terminal coupled to the second node, and a gate terminal coupled to an emission control line; and a second emission control transistor having a first terminal coupled to the third node, a second terminal coupled to an anode electrode of the organic light emitting diode, and a gate terminal coupled to the emission control line.

18. The pixel circuit of claim 14, wherein at least one of the first transistor, the second transistor, the third transistor, the fourth transistor, the fifth transistor, and the driving transistor comprises a PMOS transistor.

19. The pixel circuit of claim 14, wherein at least one of the first transistor, the second transistor, the third transistor, the fourth transistor, the fifth transistor, and the driving transistor comprises an NMOS transistor.

20. An organic light emitting device comprising a plurality of pixel circuits, each of the plurality of pixel circuits comprising:

a storage capacitor;

a first switching unit configured to initialize the storage capacitor in response to a first scan signal received from a first scan line;

a second switching unit configured to receive a second scan signal from a second scan line disposed in a first direction from the first scan line, to receive a third scan signal from a third scan line disposed in a second direction opposite to the first direction from the first scan line, and to be turned on in response to one of the second scan signal and the third scan signal that is activated after the first scan signal is activated to store a data signal in the storage capacitor;

a driving transistor configured to provide a driving current according to the data signal stored in the storage capacitor; and an organic light emitting diode configured to emit light according to the driving current, wherein the second switching unit comprises:

a second transistor configured to couple a data line through which the data signal is received to a first terminal of the driving transistor in response to the second scan signal; and a third transistor configured to couple the data line to the first terminal of the driving transistor in response to the third scan signal.

* * * * *